United States Patent [19]

Oshima et al.

[11] Patent Number: 4,457,250

[45] Date of Patent: Jul. 3, 1984

[54] FLOATING-TYPE OFFSHORE STRUCTURE

[75] Inventors: Masanao Oshima, Tokyo, Hiroshi Tabuchi, Yokohoma, both of Japan

[73] Assignee: Mitsui Engineering & Shipbuilding Co., Ltd., Tokyo, Japan

[21] Appl. No.: 330,820

[22] Filed: Dec. 15, 1981

[30] Foreign Application Priority Data

May 21, 1981 [JP] Japan ..... 56-75716

[51] Int. Cl.[3] ..... B63B 35/44

[52] U.S. Cl. ..... 114/265; 114/230; 114/293

[58] Field of Search ..... 114/264, 265, 40, 144 B, 114/230, 258, 261, 293; 405/211, 219, 217

[56] References Cited

U.S. PATENT DOCUMENTS

| | | | |
|---|---|---|---|
| 3,191,201 | 6/1965 | Richardson et al. | 114/144 B |
| 3,391,666 | 7/1968 | Schuller | 114/265 |
| 3,577,946 | 5/1971 | Horton | 114/265 |
| 3,616,773 | 11/1971 | Lloyd | 114/265 |
| 3,771,481 | 11/1973 | Goren et al. | 114/265 |
| 4,048,943 | 9/1977 | Gerwick | 114/40 |
| 4,063,428 | 12/1977 | Waas | 114/40 |
| 4,102,144 | 7/1978 | Anders | 405/211 |
| 4,174,671 | 11/1979 | Seidi | 114/265 |

OTHER PUBLICATIONS

"Cone Defense Against Ice in Arctic"; *The Oil and Gas Journal*; Apr. 27, 1970, pp. 44–45.

*Primary Examiner*—Trygve M. Blix
*Assistant Examiner*—Jesûs D. Sotelo
*Attorney, Agent, or Firm*—Armstrong, Nikaido, Marmelstein & Kubovcik

[57] ABSTRACT

A floating-type offshore structure, of which the main body comprises a lower hull and plurality of struts mounted on the struts and supporting a platform above the sea level and is moored through mooring wire ropes or chains at a predetermined offshore location, and which is adapted for use under both of an ice-covered and an iceless conditions of the sea by adjusting the amount of ballast water contained in a ballast tank or tanks formed in the lower hull and/or the struts and adapted for causing ice floes to undergo downward flexural failure on account of bending stresses when they move into the sea water along the ice contacting face of the strut which is inclined inwardly toward below.

2 Claims, 12 Drawing Figures

FLOATING-TYPE OFFSHORE STRUCTURE

BACKGROUND

The field to which the present invention pertains is concerned with floating-type offshore structures, broadly. More particularly, the present invention relates to a floating-type offshore structure adapted for use in an icy sea area in particular as well as in iceless offshore areas.

Conventionally, in operating for example an oil-well drilling in ice-covered or otherwise icy areas, it has in most cases been practised to form a sort of island at the predetermined surface site for the well drilling and, installing the drilling machinery and equipment on such artificially formed island, carry out drilling operations with the so installed machinery. A difficulty with such conventional art consists in that the artificial island cannot with ease be transferred from a first drilling site to a second one. Another difficulty is that if the water depth is so great as to exceed 30 m for example, the formation of an artificial island itself can hardly be performed.

Then, for comparable offshore operations in iceless sea areas, use is made of a self-propelled floating-type rig, a jack-up type rig or a semi-submersible rig. Inconveniently, however, these rigs are not so structured as to well stand pressures of drift ice, and their usefulness in an icy offshore area is therefore confined in summer seasons or under an iceless condition of that sea area.

In the case of semi-submersible rigs for example, they individually comprise a platform, which is supported suitably above the sea level by a plurality of struts mounted to stand on a lower hull so that the platform is not subject to influence of wave motion. If such a rig is put for use in an icy seawater area or under an icy seawater condition, however, its struts are subjected to pressures of drift ice, wherefore it cannot be stably moored by means of normally employed wire ropes.

Also, the lower hull of the rig under consideration comprises a twin hull structure, and in case the twin hull structure comprises a series of struts mounted on each of the two hull members, pressure of drift ice which the rig will undergo can widely vary depending upon various directions in which the drift ice moves. Thus, with the rig in this case, a stable position control thereof can hardly be obtained.

In the known rig structures, further, the drilling pipe extended from the platform to the sea bed is exposed to drift ice and is therefore prone to damages by floating ice pieces colliding against the same.

Accordingly, a primary object of the present invention is to eliminate the above indicated and other difficulties with the present art, and to that end, make buoyant or floating-type offshore structures employable or useful in not only iceless sea areas or iceless conditions of the sea but also ice-covered or icy sea areas or icy conditions of the sea.

Another object of the invention, which is based on the knowledge that the resistance of ice plates or floes against a bending stress is relatively low, is to cause to take place a downward flexural failure of drift ice sheet and thereby realize a minimization of the effect of pressure application by the drift ice sheet on the offshore structures.

Still another object of the invention is to minimize different influences of the pressure application by drift ice sheets at different points of or in different positions of the offshore structure which are likely depending upon a change in the direction in which the drift ice sheets move relative to the structure.

To attain these and other objects, the present invention provides a floating-type offshore structure the main body of which comprises a lower hull, a plurality of struts mounted to stand on the lower hull and a platform supported above the seawater surface by the plurality of struts and which is characterized by being provided with a ballast tank or tanks formed in the lower hull and/or the struts and also by the struts which have downwardly converging faces accepting contact by drift ice pieces or floes.

According to the present invention, the ice contacting face of the strut is downwardly converged as mentioned above, therefore it can cause an ice floe in contact with the inclined face of the strut to more easily undergo bending as it is increasingly pushed toward the strut by its following floe or floes to eventually undergo downward flexural failure with the result that the pressure the ice floe applies to the offshore structure is minimized, making the structure useful in an ice-covered condition of an ocean area.

Also, by suitably adjusting the amount of water received in the ballast tank or tanks and thereby adjusting the draft plane of the floating-type structure so as to adapt the structure for use in a semi-submerged state, it is feasible in accordance with the present invention to minimize the influence of wave motion upon the floating structure in summer seasons or under iceless conditions of the ocean.

Moreover, it is practicable according to the invention to dispose the plurality of struts in a ring arrangement surrounding a drilling pipe device so as to provide a protective means for the latter. It may further be devised to make the platform rotatable about a strut and thereby realize a minimization of the influence of ice floes upon the structure which varies depending upon variable flow directions in which the ice floes move.

The foregoing mentioned and other objects, features and advantages of the present invention will more clearly appear from considering the following description taken in conjunction with the accompanying drawings.

DRAWINGS

Figure 5:
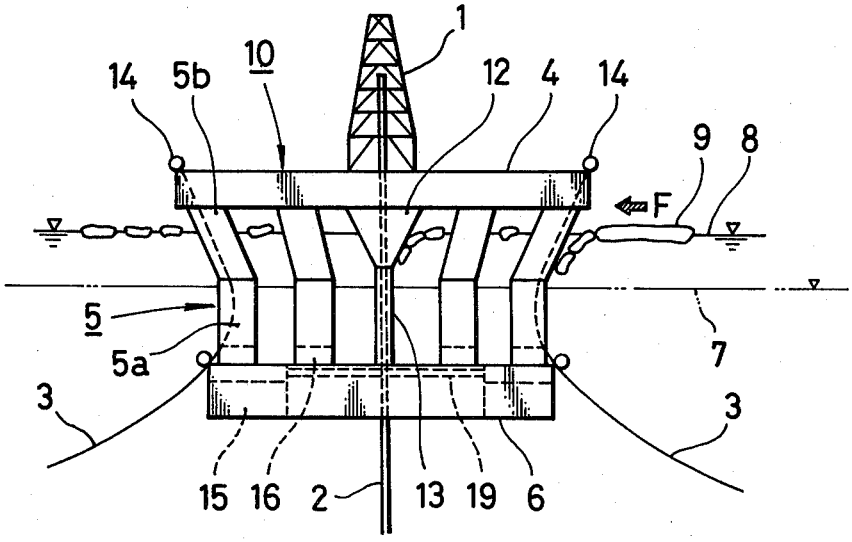
Figure 6:
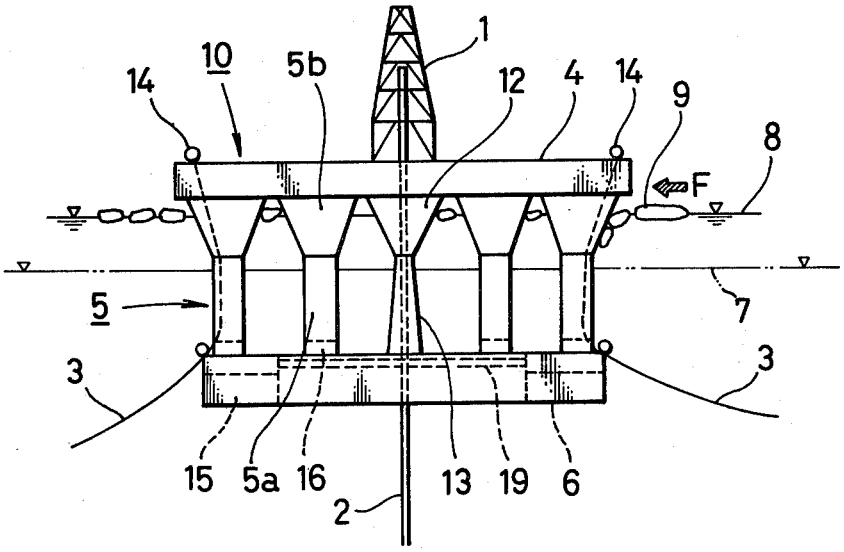
Figure 7:
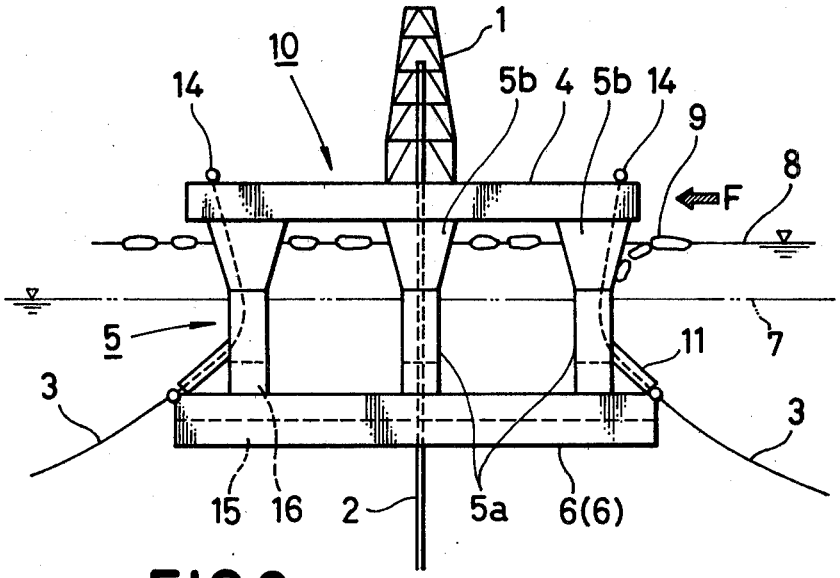
Figure 8:
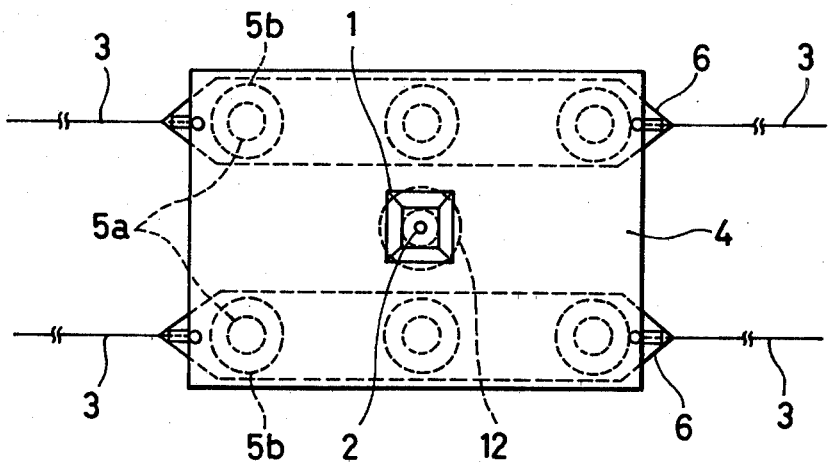
Figure 9:
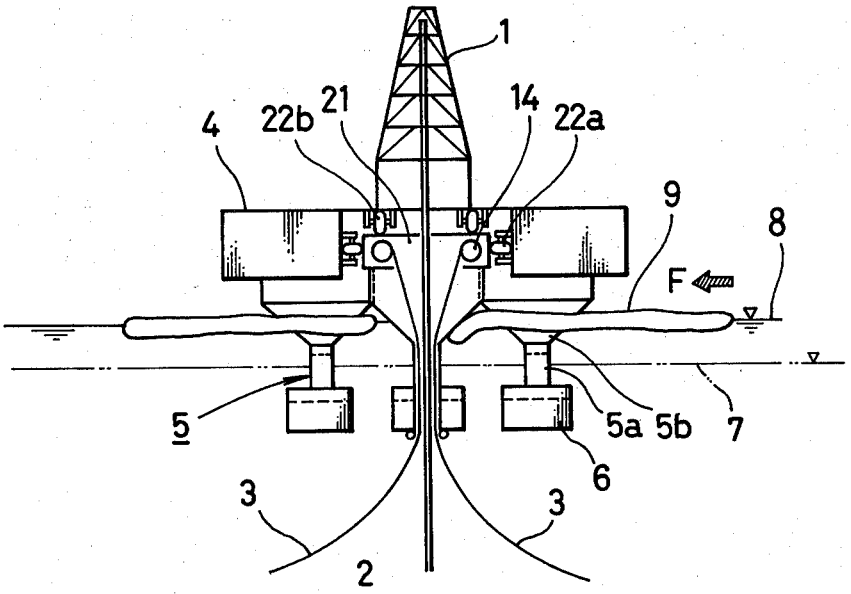
Figure 10:
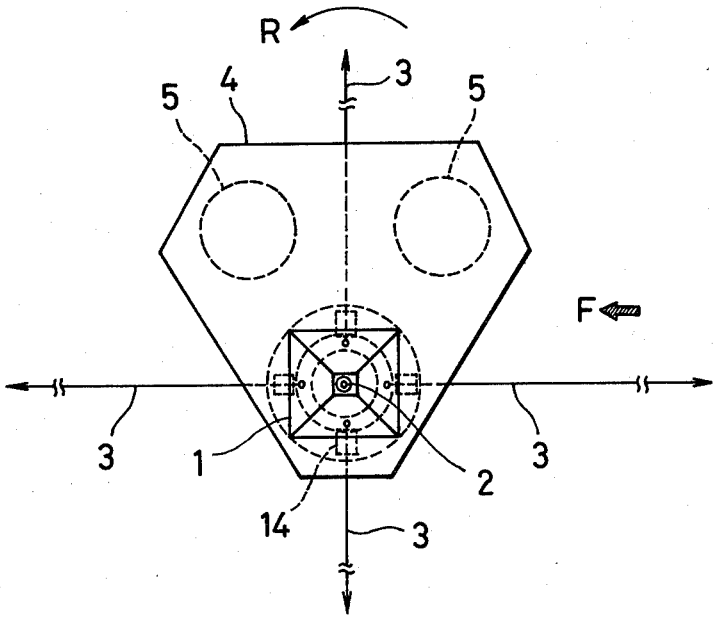
Figure 11:
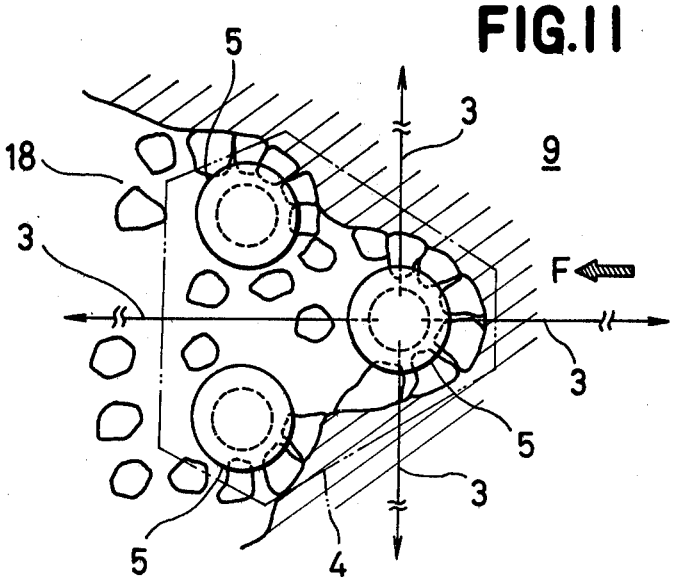
Figure 12:
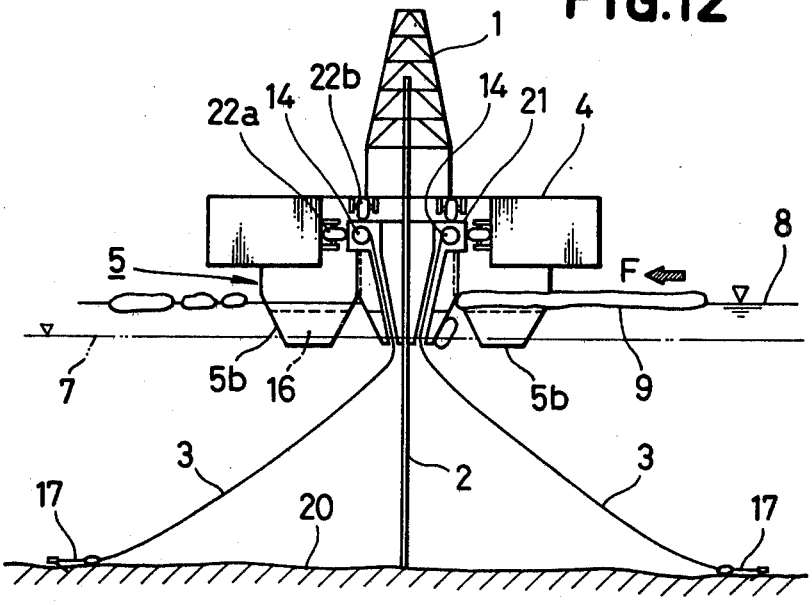

FIGS. 5, 6 and 7 respectively show in side elevation a further embodiment of the present invention;

FIG. 8 is a top plan view of FIG. 7;

FIG. 9 is a partly sectional side elevational view of a still further embodiment of the present invention;

FIG. 10 is a top plan view of FIG. 9;

FIG. 11 shows a sectional plan view of the structure shown in FIG. 9, taken for illustration of a manner in which an ice floe is undergoing downward flexural failure against the structure; and FIG. 12 is a partly sectional side elevational view, showing a yet still another embodiment of the present invention.

ILLUSTRATED EMBODIMENTS

Figure 1:
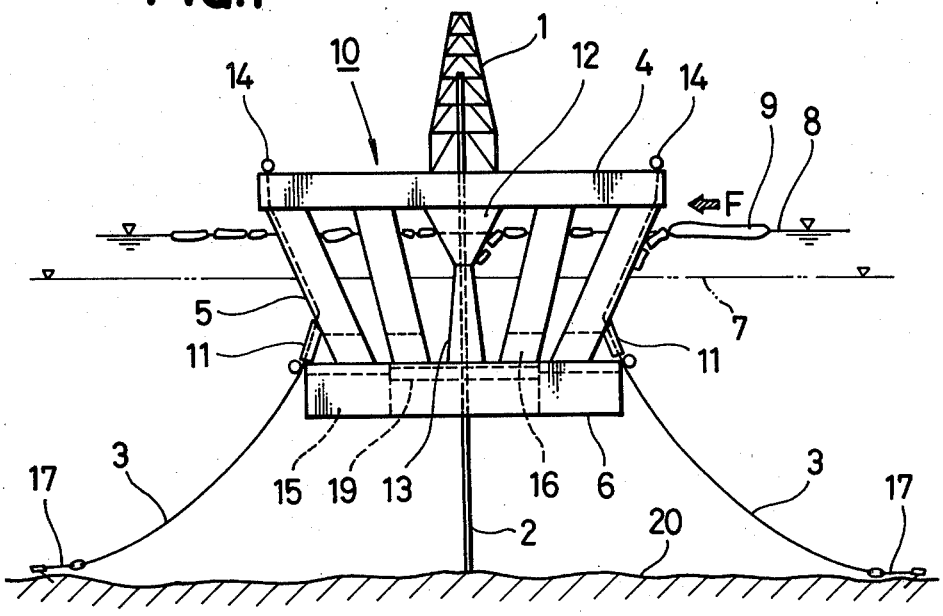
FIG. 1 shows a side elevational view of a floating-type offshore structure embodying the present invention.
Figure 2:
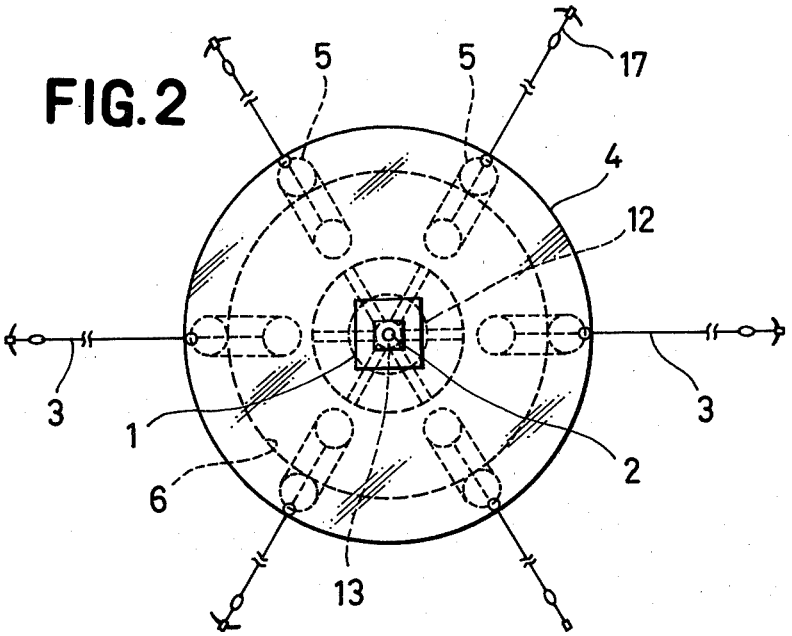
FIG. 2 is a top plan view of FIG. 1.

Referring to FIGS. 1 and 2, the main body therein indicated at 10 of a floating-type or buoyant offshore structure representing a first embodiment of the present invention comprises a disc-like platform 4 supported by a plurality of struts 5 mounted to stand on a ring-shaped lower hull 6.

At a central portion of the platform 4, there is disposed a drilling rig assembly or derrick 1, which supports a drilling pipe device 2 extended from the main body 10 of the structure toward the sea bed 20.

The plurality of struts 5 which individually have a cylindrical configuration are disposed in an annular arrangement. This structuring and arrangement of struts 5 can effectively diminish the change in the influence of pressures by ice floes which is variable depending upon a change in the flow direction of floes relative to the structure. Struts 5 are also mounted at an inclination such that their upper ends at which they are secured to the platform 4 lie radially farther from the center of the platform than their lower ends, which are secured to the ring of the lower hull 6.

The platform 4 has secured on its lower face a shield 12 of a downwardly converging or upwardly flared frustoconical shape, for protection of the drilling pipe device 2, and to the shield 12 there is connected a frustoconical pipe cover 13, the lower end of which is secured to a support member 19 projected from the lower hull 6. What can be permitted to contact the pipe cover 13 are only such fragments of ice as having been broken against struts 5 and/or shield 12, so that if it is made of a straight cylindrical member as opposed to a conical member, practically there may not be a difficulty involved.

With the shield 12, however, this has an upwardly flared conical or frustoconical shape and its water-plane area is upwardly increasingly greater so that it is more susceptive of influence of wave at its upper portion than its lower portion. Thus, the height of the shield 12 should preferably be determined such that the lower end thereof does not protrude below the draft plane 7 at the time of use of the structure in an iceless sea area or under an iceless condition of the sea.

The main body 10 is moored through wire ropes or chains 3 provided at their leading ends with an anchor 17 respectively. Mooring wire ropes or chains 3 are wound or unwound by winches 14 installed on the platform 4, through guide cylinders 11 secured to struts 5.

A ballast tank 15 is formed in the lower hull 6, and also in each strut 5, the ballast tanks in struts 5 being shown at 16. In this connection, it will be readily appreciated that the ballast tank may be provided in only the lower hull 6 or in the strut 5 alone.

Figure 3:
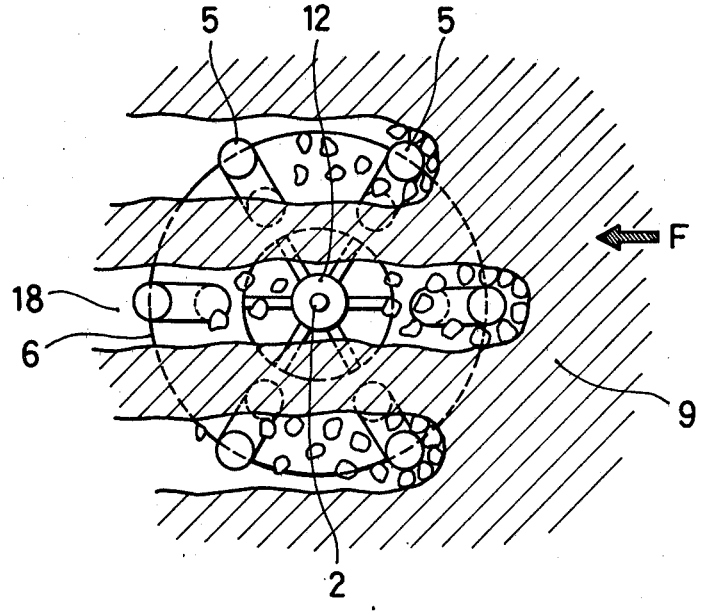
FIGS. 3 and 4 are respectively a sectional plan view, taken for illustration of a manner in which an ice floe is undergoing downward flexural failure against the offshore structure of the invention.
Figure 4:
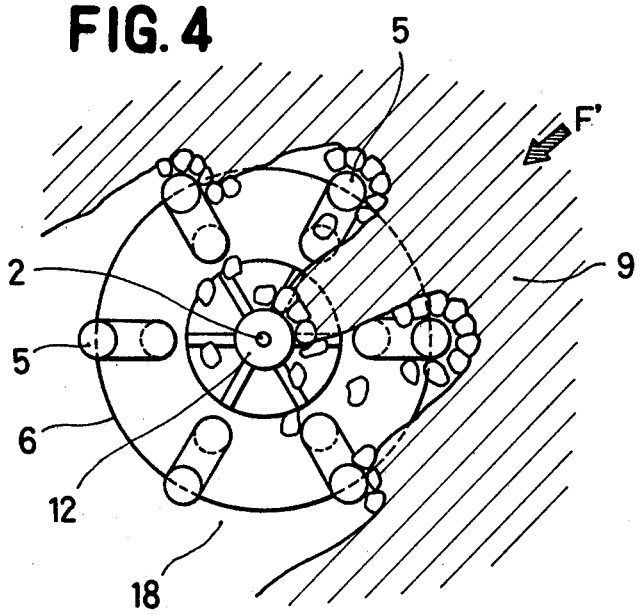

The reference numeral 8 represents the plane of the draft in an icy sea area or under an ice-covered seawater condition, 9 being drift ice pieces or ice sheets, 18 being water openings (FIGS. 3, 4 and 11).

In an ice-covered sea area, the offshore structure may best be operated to by adjusting the amount of water in the ballast tanks 15 and 16 so that the draft of the structure substantially corresponds to the draft plane 8.

As seen from FIGS. 1 and 3, in which ice floes 9 are moving in the direction indicated by an arrow F, ice floes coming into contact with the strut 5 of the structure are forced by the pushing of a next coming drift ice piece or pieces, downward into the seawater along the surface of the slantways mounted strut 5, where they undergo breaking or crushing on account of bending stresses. Then, as best seen in FIG. 3, portions of ice floe which have so approached the structure as to lie between each adjacent struts 5 can pass without being broken through interspaces between the adjacent struts 5, so that the pressure applied to the structure can be greatly diminished.

Further, when as shown in FIG. 4 an ice floe approaches the structure in the direction represented by an arrow F', the downward flexural failure of the ice floe will take place about a plurality of struts 5 and also about the shield 12.

On the other hand, in an iceless sea area or under an iceless ocean condition such as in summer in an ice-covered ocean area, the ballast tanks 15 and 16 may be charged with a smaller amount of water so as to suitably adjust the draft of the structure to essentially correspond to the draft plane 7 shown in FIG. 1. In this case, the shield 12 can take its position above the draft plane 7, so that the water plane area of the struts 5 and the pipe cover 13 becomes reduced and, accordingly, reduces the influence of waves on the structure, with the result that the structure is stabilized in its position, enabling the intended offshore operation to be performed in safety.

FIG. 5 illustrates another embodiment of the present invention, in which structural members having identical structural and functional features with those of the first embodiment described above in conjunction with the illustration in FIGS. 1 to 3 are indicated by same reference characters as in FIGS. 1 to 3.

In this second embodiment being considered, the strut 5 is so designed as to comprise an erect or upright lower half part **5*a* and a slant upper half part 5*b* which is radially outwardly inclined toward up. According to the designing of this example, the water plane area on the draft plane 7 can be reduced in comparison to that in the example illustrated in FIG. 1**, so that influence of ocean waves on the structure will accordingly be suppressed.

FIG. 6 shows a still another embodiment of the invention, in which, similar to the illustration in FIG. 5, identical reference characters represent identical structural members with those in FIG. 1. As shown, the strut 5 in FIG. 6 comprises an erect or upright lower half part **5*a* and an upwardly flared truncated conical upper half part 5*b*. Being thus designed, all of a plurality of struts 5** can exhibit no difference in their function to break contacting or colliding drift ice pieces or floes.

Shown in FIGS. 7 and 8 is a further modified example of the floating-type offshore structure shown in FIG. 6, in which example two lower hulls 6 are made in the shape of a ship or pontoon, the two hull members being disposed parallel to each other as in a twin-hull ship or catamaran. In comparison to the structure shown in FIG. 6, the structure of FIGS. 7 and 8 can be transferred with less resistance encountered and can therefore be moved with more ease from a location to another on the sea.

FIGS. 9 and 10 show a yet still another embodiment of the invention, in which similar structural members as in the first embodiment shown in FIG. 1 are shown again by similar reference characters as in FIG. 1. In the embodiment of FIGS. 9 and 10, three (3) struts 5 are disposed in a triangular arrangement, and adapted to altogether support the platform 4. Each strut 5, which is mounted on the lower hull 6, comprises a cylindrical lower half part 5a and an upwardly flared frustoconical upper half part 5b.

Further, one of the three struts is rotatably mounted relative to the platform 4 and has secured thereon a winch chamber 21, of which the side ends are supported by rollers 22a mounted to the platform 4 and the upper face is borne by rollers 22b also mounted to the platform 4.

As best seen from FIG. 10, the derrick 1 is built up at a central portion of the rotatable one of struts 5, and the drilling pipe device 2 is extended toward the sea bed through the rotatable strut. Within the winch chamber 21, winches 14 are housed, and mooring wire ropes 3 which are drawn from the winches 14 are extended to reach the sea bed also through the rotatable strut 5.

The floating-type offshore structure being designed as above, when ice floes coming toward the structure in the direction of the arrow F contact and exert pressures against the main body 10 of the structure as shown in FIG. 10, the main body 10 or the structure as a whole undergoes rotation in the direction of an arrow R with the rotatable strut 5 as the center of the rotation to take a position as shown in FIG. 11. When this condition is met of the structure, there will no longer be different influences of the pressure application by the floes which otherwise are likely about different points of the structure depending upon the relationship between the position of the structure and the direction in which floes collide against the structure.

FIG. 12 shows a further embodiment of the present invention, which, while comprising a structure closely resembling the one shown in FIG. 9, is devoid of the lower hull 6 and the lower strut parts 5a of the structure shown in FIG. 9, providing a simplified floating-type offshore structure.

What is claimed is:

1. A floating-type offshore structure adapted to be anchored by mooring lines and comprising a plurality of struts having a buoyancy and a platform supported on said plurality of struts, each of said struts at least partly comprising a downwardly converging frustoconical configuration, one of said struts being rotatably supported by the platform and having said mooring lines passing therethrough.

2. A floating-type offshore structure, for use in ice-prone waters having a main body comprising a platform and a plurality of strut members, each of said strut members having an upper portion and a lower portion, said upper portions being attached to the lower surface of said platform and having a downwardly converging frustoconical configuration, said lower portions having ballast tanks disposed therein for adjusting a draft plane of said structure, said structure being positionable by adjustment of ballast to float with its draft plane at the upper region of said frustoconical portions under ice-prone conditions, said structure having mooring lines connected to said main body, one of said strut members being rotatably attached to said platform, and said mooring lines being disposed through said rotatable strut member.

* * * * *